US007540353B2

(12) United States Patent
Okawa et al.

(10) Patent No.: US 7,540,353 B2
(45) Date of Patent: Jun. 2, 2009

(54) RESONATOR

(75) Inventors: Shintarou Okawa, Aichi-ken (JP); Tomoyuki Sawatari, Aichi-ken (JP); Yoshikazu Hirose, Aichi-ken (JP); Minoru Toyoda, Aichi-ken (JP); Masaru Hattori, Aichi-ken (JP); Tatsuo Suzuki, Aichi-ken (JP); Hiroshi Iwao, Aichi-ken (JP); Yutaka Ogasawara, Aichi-ken (JP)

(73) Assignee: Toyoda Gosei Co., Ltd., Aichi-pref. (JP)

( * ) Notice: Subject to any disclaimer, the term of this patent is extended or adjusted under 35 U.S.C. 154(b) by 206 days.

(21) Appl. No.: 11/238,121

(22) Filed: Sep. 29, 2005

(65) Prior Publication Data

US 2006/0065479 A1 Mar. 30, 2006

(30) Foreign Application Priority Data

Sep. 29, 2004 (JP) ..... 2004-284651
May 9, 2005 (JP) ..... 2005-136037

(51) Int. Cl.
*F01N 1/02* (2006.01)
*F02M 35/10* (2006.01)

(52) U.S. Cl. ..... 181/250; 181/273; 181/276; 123/184.57

(58) Field of Classification Search ..... 181/250, 181/273, 276, 277, 219; 123/184.57, 184.53, 123/184.54, 184.55, 184.56, 184.58
See application file for complete search history.

(56) References Cited

U.S. PATENT DOCUMENTS 1,910,672 A * 5/1933 Bourne ..... 181/276
3,866,001 A * 2/1975 Kleinschmidt et al. ..... 181/285
4,353,211 A * 10/1982 Cser et al. ..... 60/605.1
5,156,116 A * 10/1992 Scherenberg ..... 123/184.44
5,333,576 A * 8/1994 Verkleeren ..... 123/184.53
5,349,141 A * 9/1994 Horibe et al. ..... 181/224
5,700,983 A * 12/1997 VonDross ..... 181/285
5,756,945 A * 5/1998 Maeda et al.

(Continued)

FOREIGN PATENT DOCUMENTS

DE 1052169 * 3/1959

(Continued)

OTHER PUBLICATIONS

Chinese Office Action issued on Jun. 22, 2007 in corresponding Chinese Patent Application No. 200510108144.X (and English translation).

(Continued)

*Primary Examiner*—Jeffrey Donels
*Assistant Examiner*—Forrest M Phillips
(74) *Attorney, Agent, or Firm*—Posz Law Group, PLC

(57) ABSTRACT

A resonator is arranged in an intake system including a pipe section for partitioning an intake port from an intake passage that communicates the intake port with a combustion chamber of an engine, the resonator including: a branch pipe having one end branching to the pipe section and the other end closed so that a silencing chamber is defined therein; and at least one partition wall for partitioning the silencing chamber into at least one pneumatic spring chamber, the partition wall having a natural frequency lower than the frequency of silencing target sound of intake noise propagated from the intake passage.

12 Claims, 14 Drawing Sheets

U.S. PATENT DOCUMENTS

| | | | | | |
|---|---|---|---|---|---|
| 5,959,264 | A * | 9/1999 | Bruck et al. | 181/286 |
| 5,996,733 | A * | 12/1999 | DeTuncq et al. | 181/250 |
| 6,508,331 | B1 * | 1/2003 | Stuart | 181/250 |
| 6,609,489 | B1 * | 8/2003 | Slopsema et al. | 123/184.57 |
| 6,634,457 | B2 * | 10/2003 | Paschereit et al. | 181/229 |
| 6,698,390 | B1 * | 3/2004 | Kostun et al. | 123/184.57 |
| 6,739,425 | B1 * | 5/2004 | Griffin et al. | 181/171 |
| 7,188,703 | B2 * | 3/2007 | Hofmann et al. | 181/271 |
| 2005/0173186 | A1 * | 8/2005 | Kino et al. | 181/250 |
| 2006/0042873 | A1 * | 3/2006 | Alex et al. | 181/250 |
| 2006/0065479 | A1 * | 3/2006 | Okawa et al. | 181/250 |

FOREIGN PATENT DOCUMENTS

| | | | |
|---|---|---|---|
| EP | 1 111 228 | * | 6/2001 |
| FR | 2840652 | * | 12/2003 |
| JP | 58124057 A | * | 7/1983 |
| JP | A-58-124057 | | 7/1983 |
| JP | S59-170672 | | 11/1984 |
| JP | U-H02-80710 | | 6/1990 |
| JP | A-04-347312 | | 12/1992 |
| JP | A-08-128368 | | 5/1996 |

OTHER PUBLICATIONS

Office Action dated Dec. 23, 2008 in corresponding German patent application No. 102005046200.6 (and English translation).*

* cited by examiner

RESONATOR

BACKGROUND OF THE INVENTION

1. Field of the Invention

The present invention relates to a resonator for suppressing the intake noise of an intake system for a vehicle.

2. Related Art

A side branch resonator or a Helmholtz resonator has been used in the related art in order to suppress intake noise of an intake system. Such a related art resonator has a disadvantage that a larger installation space for a resonator is required in case the sound pressure of a lower frequency component with lower frequency of intake noise is to be suppressed.

For a side branch resonator, the natural frequency of sound that can be silenced by resonance depends on the length of the side branch. Meanwhile, the wavelength becomes longer as the signal component becomes lower. In order to suppress a low frequency component by using a side branch resonator, the side branch length must be increased. This increases the installation space for the resonator.

For a Helmholtz resonator, the natural frequency of sound that can be silenced by resonance is represented by the following expression:

$$f = \frac{c}{2\pi}\sqrt{\frac{S}{l \cdot V}} \qquad \text{(Expression 1)}$$

In the above expression, f represents a natural frequency (resonance frequency), c a sound velocity, l the length of a communication pipe, V the volume of a cavity chamber, and S the cross-sectional area of the communication pipe. To suppress a low frequency component, it is necessary to reduce the natural frequency f. To reduce the natural frequency f, it is necessary to increase l or V with respect to S. In this case also, the installation space for the resonator is increased.

A resonator having a small installation space is described in JP-UM-A-2-080710. The resonator comprises an elastic film and a cup member. The cup member is attached to a surge tank with the cup opening turned down. Between the cup opening and the surge tank is interposed an elastic film. The elastic film separates the cup interior from the surge tank interior.

The natural frequency of the elastic film is set to be equal to the resonance frequency of columnar resonance in the surge tank. The resonator described in JP-UM-A-2-080710 is capable of suppressing columnar pulsation in the surge tank by way of the film vibration effect of the elastic film.

A problem with the resonator described in JP-UM-A-2-080710 is that it is difficult to maintain a desired sound pressure suppression effect for a substantial period of time. In other words, the natural frequency of an elastic film must be constantly maintained to be equal to the frequency of the resonance frequency of columnar resonance. The natural frequency of the elastic film depends on the tension of the elastic film. The tension of an elastic film gradually decreases with time from when the elastic film is installed. Thus, it is difficult for the resonator described in JP-UM-A-2-080710 to maintain a desired sound pressure suppression effect for a substantial period of time.

SUMMARY OF THE INVENTION

A resonator according to the invention has been accomplished in view of the above problems. An object of the invention is to provide a resonator having a small installation space that readily maintains a desired sound pressure suppression effect.

(1) In order to solve the problems, the invention provides a resonator arranged in an intake system comprising a pipe section for partitioning an intake port from an intake passage that communicates the intake port with a combustion chamber of an engine, the resonator comprising: a branch pipe having one end branching to the pipe section and another end closed so that a silencing chamber is defined therein; and at least one partitioning member for partitioning the silencing chamber into at least one pneumatic spring chamber, the partitioning member having a natural frequency lower than the frequency of silencing target sound of intake noise propagated from the intake passage.

The resonator according to the invention utilizes the mass effect of a partitioning member. In other words, resonance of a partitioning member and the air in the pneumatic spring chamber adjacent to the rear of the partitioning member is used to suppress the sound pressure of the frequency of the silencing target sound. Unlike the resonator described in JP-UM-A-2-080710, the inventive resonator does not utilize the film vibration effect. The term "rear" of the partitioning member herein refers to the side opposite to the side where intake noise is input as seen from the partitioning member.

Thus, the natural frequency of the partitioning member of the resonator according to the invention is set lower than the frequency of the silencing target sound of the intake noise. Even when the tension of the partitioning member is decreased and the natural frequency of the partitioning member lowered, the mass effect of the partitioning member is not degraded. The resonator according to the invention thus readily maintains a desired sound pressure suppression effect.

For the resonator according to the invention, the internal attenuation of the partitioning member itself produces unsharpened echo resonance (a portion where the sound pressure appearing on high frequencies or low frequencies of the resonance frequency is high). This makes it possible to reduce the sound pressure of echo resonance.

(2) The silencing chamber may comprise a communication pipe which directly communicates with the intake passage and to which the silencing target sound is propagated from the intake passage and a cavity chamber communicating with the communication pipe, the cavity chamber having a larger cross sectional area in vertical direction with respect to the propagation direction of the silencing target sound than that of the communication pipe, and the partitioning member may be arranged in the cavity chamber.

This configuration embodies the resonator according to the invention as a Helmholtz resonator. According to the configuration, it is possible to shift the natural frequency of a resonator toward lower frequencies than a Helmholtz resonator of the same shape. It is further possible to more compact resonator than a Helmholtz resonator to which the frequency of the same silencing target sound is set.

(3) The silencing chamber preferably comprises a communication pipe which directly communicates with the intake passage and to which the silencing target sound is propagated from the intake passage and a cavity chamber communicating with the communication pipe, the cavity chamber having a larger cross sectional area in vertical direction with respect to the propagation direction of the silencing target sound than that of the communication pipe, and the partitioning member is preferably arranged in the communication pipe.

The silencing effect of the resonator according to the invention depends on the volume of the cavity chamber, not on its shape. Thus, according to the invention, a resonator may be designed in any shape as long as its volume is kept constant. For example, the cavity chamber may be provided having a large width and small thickness. Thus adds to space saving. By tailoring the shape of the cavity chamber to the shape of the pipe section of the intake system, the freedom of arrangement of the resonator is dramatically enhanced.

(4) In this case, the communication pipe is preferably positioned inside the cavity chamber. By doing so, a projection is not formed outside the cavity chamber, which provides a lower-profile resonator design.

(5) Preferably, the natural frequency of the partitioning member is less than 10 percent of the resonance frequency of the resonance s less than 10 percent of the resonance frequency of the resonance sound calculated from the mass of the partitioning member and the spring constant of the pneumatic spring chamber with the latter being assumed as 100 percent. This is because the natural frequency of the resonator would otherwise be shifted toward higher frequencies by 10 percent or more with respect to the frequency of the silencing target sound.

(6) Preferably, the spring constant of the partitioning member is less than 1 percent assuming the spring constant of the pneumatic spring chamber adjacent to the rear of the partitioning member as 100 percent. This is because the spring effect would otherwise become non-negligible and the natural frequency of the resonator would be shifted toward higher frequencies by 10 percent or more with respect to the frequency of the silencing target sound.

(7) Preferably, the branch pipe is arranged at a site where the antinode of a standing wave of the silencing target sound of the intake noise is positioned in the pipe section. The antinode of a standing wave has a large sound pressure. With this configuration, it is possible to more efficiently lower the sound pressure of the silencing target sound.

According to the invention, it is possible to provide a resonator having a small installation space that readily maintains a desired sound pressure suppression effect.

DETAILED DESCRIPTION OF THE PREFERRED EMBODIMENTS

Embodiments of the resonator according to the invention will be described below.

Figure 1:
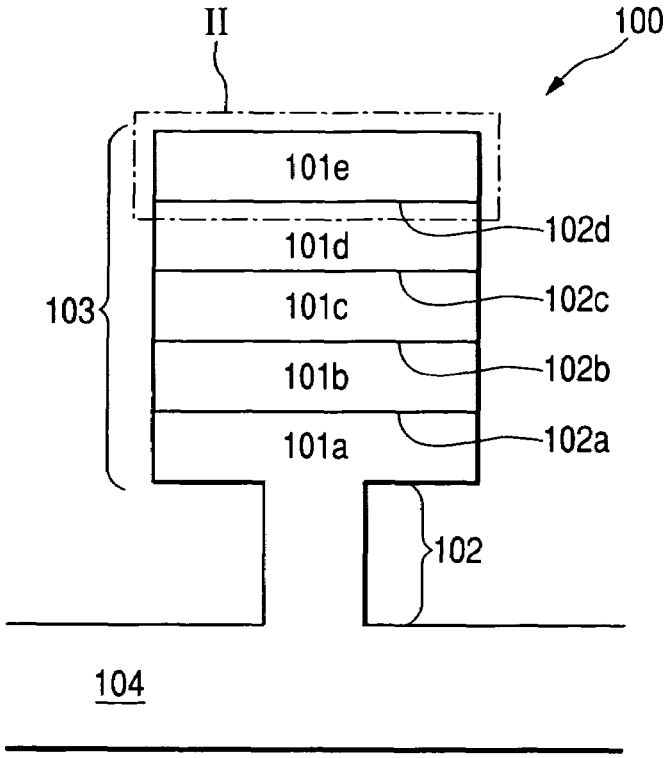
FIG. 1 is a schematic view of a resonator according to the invention.

FIG. 1 shows a schematic view of a resonator according to the embodiment. The resonator shown in FIG. 1 is one according to the embodiment presented in schematic form as a Helmholtz resonator. Note that the inventive resonator is not limited to that shown in FIG. 1. For example, it may be used as another type of resonator such as a side branch resonator.

As shown in FIG. 1, a resonator 100 comprises a communication pipe 102 and a cavity chamber 103. The communication pipe 102 and the cavity chamber 103 constitute a silencing chamber of the embodiment. The communication pipe 102 is in communication with an intake passage 104. The cavity chamber 103 is partitioned by total four partition walls 102*a*, through 102*d*, (corresponding to "partitioning member" of the invention). The cavity chamber 103 is divided into total five pneumatic spring chambers 101*a* through 101*e*.

Figure 2:
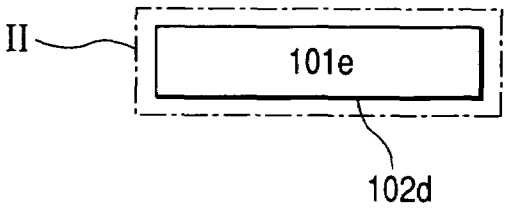
FIG. 2 is an enlarged view of the elements in the frame II.

FIG. 2 shows the pneumatic spring chamber 101*e* and the partition wall picked up from the frame II of FIG. 1. As shown in FIG. 2, the pneumatic spring chamber 101*e* is sealed by the partition wall 102*d*. The natural frequency of the partition wall 102*d* is set lower than the frequency of the silencing target sound of the intake noise. Thus, the partition wall 102*d* does not vibrate from resonance depending on silencing target sound of the intake noise. The partition wall 102*d* is equivalent to a mass. The pneumatic spring chamber 101*e* and the partition wall 102*d* are equivalent to a spring and a plumb that are serially connected. The cavity chamber and the communication pipe pf a Helmholtz resonator can be approximated as a spring and a plumb that are serially connected. Thus, the pneumatic spring chamber 101*e* and the partition wall 102*d* can be represented as a Helmholtz resonator.

Figure 3:
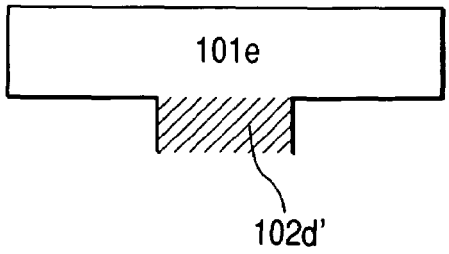
FIG. 3 is a schematic view of the pneumatic spring chambers and the partition walls shown in FIG. 2 represented as a Helmholtz resonator.

FIG. 3 is a schematic view of the pneumatic spring chambers and the partition walls shown in FIG. 2 represented as a Helmholtz resonator. Sections corresponding to FIG. 2 are assigned same signs. The mass of the communication pipe 102*d*' (hatched for ease of description) is equivalent to the partition wall 102*d* in FIG. 2. The pneumatic spring chambers 101*a* through 101*d* and partition walls 102*a* through 10*c* shown in FIG. 1 may be represented as a Helmholtz resonator.

Figure 4:
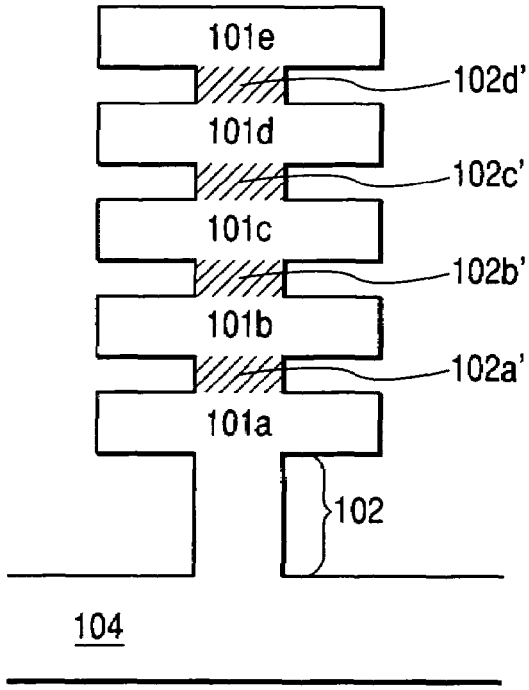
FIG. 4 is a schematic view of all the pneumatic spring chambers and the partition walls shown in FIG. 1 represented as a Helmholtz resonator.

FIG. 4 is a schematic view of all the pneumatic spring chambers and the partition walls shown in FIG. 1 represented as a Helmholtz resonator. Sections corresponding to FIG. 1 are assigned same signs. The partition wall 102*a* in FIG. 1, the partition wall 102*b* in FIG. 1, partition wall 102*c* in FIG. 1, and partition wall 102*d* in FIG. 1 are respectively equivalent to the mass of the communication pipe 102*a*' in FIG. 4, the mass of the communication pipe 102*b*' in FIG. 4, the mass of the communication pipe 102*c*' in FIG. 4, and the mass of the communication pipe 102*d*' in FIG. 4.

Figure 5:
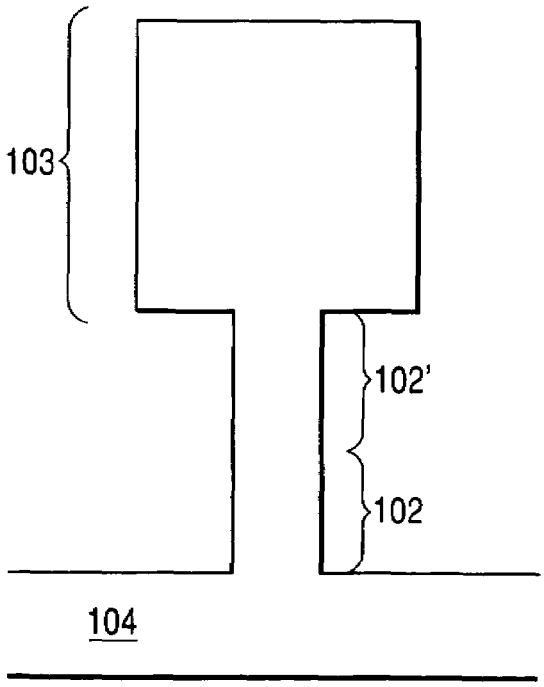
FIG. 5 is a schematic view of the resonator shown in FIG. 4 represented as a related art Helmholtz resonator.

FIG. 5 is a schematic view of the resonator shown in FIG. 4 represented as a related art Helmholtz resonator. Sections corresponding to FIG. 1 are assigned same signs. As shown in FIG. 5, the volume of the cavity chamber 103 is the volume sum of the pneumatic spring chambers 101*a* through 101*e*. The volume of the communication pipe extension part 102' is the volume sum of the communication pipes 102*a*' through 102*d*'.

As understood from the comparison between the related art resonator shown in FIG. 5 and the inventive resonator shown in FIG. 1, the inventive resonator 100 is more compact than the relater art resonator by the volume of the communication pipe extension part 102'.

In this way, the partition walls of the resonator according to the embodiment are equivalent to the mass of the communication pipes of the related art Helmholtz resonator. Thus, the resonator according to the embodiment requires a smaller installation space.

Figure 6:
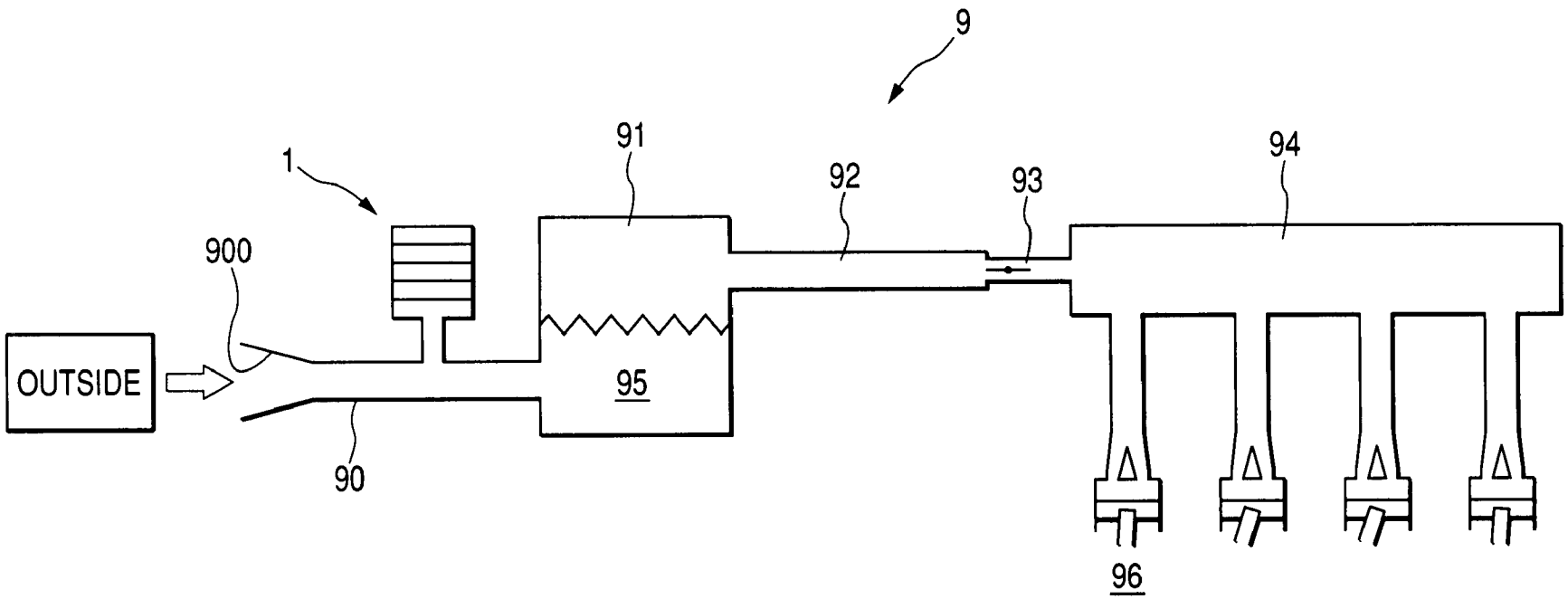
FIG. 6 is a schematic view of an intake system in which the resonator according to an embodiment of the invention is arranged.

First, the arrangement of the resonator according to the embodiment is described. FIG. 6 is a schematic view of an intake system in which the resonator of this embodiment is arranged. As shown in FIG. 6, the intake system 9 comprises an intake duct 90, an air cleaner 91, an air cleaner hose (outlet) 92, a throttle body 93, and an intake manifold 94. Inside the intake system 9 is partitioned an intake passage 95 in communication with an intake port 90 formed upstream of the intake duct 90 (upstream and downstream directions are hereinafter defined in accordance with the flow of air) and a combustion chamber 96 branching downstream of the intake manifold 94. Via the intake passage 95 is introduced intake air into the combustion chamber 96 from outside. Via the intake passage 95 is propagated intake noise from the combustion chamber 96 to outside. The resonator 1 branches to the intake duct 90. The resonator 1 is coupled to the antinode of the standing wave of the silencing target sound of the intake noise.

Figure 7:
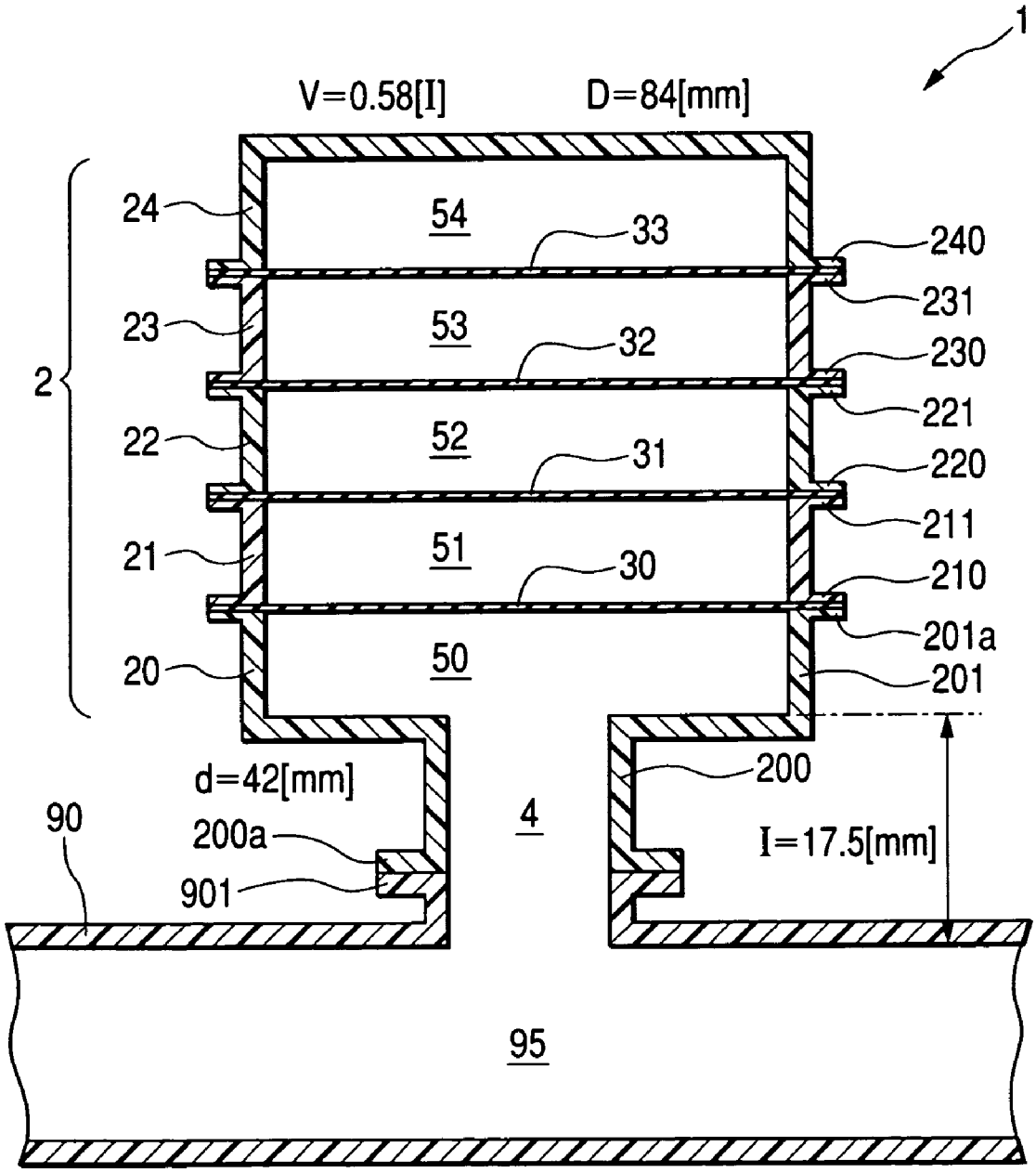
FIG. 7 is a cross-sectional view of the resonator shown in FIG. 6.

FIG. 7 is across-sectional view of the resonator according to the embodiment. As shown in FIG. 7, the resonator 1 comprises a branch pipe 2 and diaphragms 30 through 33. The diaphragms 30 through 33 are included in the partition walls of the embodiment. The branch pipe 2 comprises a mounting base part 20, intermediate coupling parts 21 through 23, and an end part 24.

The mounting base part 20 is made of a resin and comprises a small diameter part 200 and a large diameter part 201. The small diameter part 200 has a cylindrical shape. At the opening end of the small diameter part 200 is formed a flange part 200*a* on the small diameter part. From the side wall of the intake duct 90 are protruded a flange part 901 on the duct. The flange part 200*a* on the small diameter part is fixed to the flange part 901 on the duct with a screw (not shown). Between the intake passage 95 and a pneumatic spring chamber 50 mentioned later is interposed a communication pipe 4. In other words, the intake passage 95 is in communication with the communication pipe 4. The large diameter part 201 has a shape of s cylinder having a larger diameter than the small diameter part. Inside the large diameter part 201 is partitioned a pneumatic spring chamber 50. At the opening end of the large diameter part 201 is formed a flange part 201*a* on the small diameter part.

The intermediate coupling part 21 is made of a resin and has a shape of a cylinder having the same diameter as the large diameter part 201. Inside the intermediate coupling part 21 is partitioned a pneumatic spring chamber 51. At both opening ends of the intermediate coupling part 21 are respectively formed flange parts 210, 211 on the intermediate coupling part. The flange part 210 on the intermediate coupling part is fixed to the flange part 201*a* on the large diameter part with a screw (not shown).

The diaphragm 30 is made of rubber and has a shape of a thin disc. The diaphragm 30 is sandwiched between and fixed to the flange part 210 on the intermediate coupling part and the flange part 201*a* on the small diameter part with the screw.

The intermediate coupling part 22 has a shape similar to that of the intermediate coupling part 21. Inside the intermediate coupling part 22 is partitioned a pneumatic spring chamber 52. At both opening ends of the intermediate coupling part 22 are respectively formed flange parts 220, 221 on the intermediate coupling part. The flange part 220 on the intermediate coupling part is fixed to the flange part 211 on the intermediate coupling part of the intermediate coupling part 21 with a screw (not shown).

The diaphragm 31 has a shape similar to that of the diaphragm 30. The diaphragm 31 is sandwiched between and fixed to the flange part 220 on the intermediate coupling part and the flange part 211 on the intermediate coupling part of the intermediate coupling part 21.

The intermediate coupling part 23 has a shape similar to that of the intermediate coupling part 22. Inside the intermediate coupling part 23 is partitioned a pneumatic spring chamber 53. At both opening ends of the intermediate coupling part 23 are respectively formed flange parts 230, 231 on the intermediate coupling part. The flange part 230 on the intermediate coupling part is fixed to the flange part 221 on the intermediate coupling part of the intermediate coupling part 22 with a screw (not shown).

The diaphragm 32 has a shape similar to that of the diaphragm 31. The diaphragm 32 is sandwiched between and fixed to the flange part 230 on the intermediate coupling part and the flange part 221 on the intermediate coupling part of the intermediate coupling part 22.

The end part 24 is made of a resin and has a shape of a cylinder with a bottom. Inside the end part 24 is partitioned a pneumatic spring chamber 54. At the opening end of the end part 24 is formed a flange part 240 on the end part. The flange part 240 on the end part is fixed to the flange part 231 on the intermediate coupling part with a screw (not shown).

The diaphragm 33 has a shape similar to that of the diaphragm 32. The diaphragm 33 is sandwiched between and fixed to the flange part 240 on the end part and the flange part 231 on the intermediate coupling part of the intermediate coupling part 23.

In this way, inside the branch pipe 2 are formed one communication pipe 4 and a total five pneumatic spring chambers 50 through 54. The five pneumatic spring chambers 50 through 54 are respectively partitioned by the diaphragms 30 through 33. The five pneumatic spring chambers 50 through 54 constitute the cavity chamber of the embodiment. The cavity chamber and the communication pipe 4 constitute the silencing chamber of the embodiment.

The embodiment of the resonator according to the invention has been described. Note that the invention is not limited to the above embodiment. A variety of modifications and adaptations will readily occur to those skilled in the art.

While the resonator 1 is formed based on a Helmholtz resonator, the resonator may be formed in accordance with a side branch resonator. While the external shape of the resonator 1 is a cylinder in the embodiment, it maybe a prismatic cylinder. The number of diaphragms 30 through 33 is not particularly limited. For example, the number may be one. In this case, a single diaphragm may be interposed between the intake passage and the opening edge of the branch pipe. That is, a diaphragm may be used to seal the branch pipe. This partition walls a single pneumatic spring chamber in the branch pipe.

While diaphragms 30 through 33 are arranged as partition walls in the embodiment, a partition wall other than a diaphragm may be used as long as the partition wall has a natural frequency and a pneumatic spring chamber can be formed at the rear of the partition wall. For example, a block-shaped partition wall may be displaceably held in the branch pipe 2. While the diaphragms 30 through 33 are fixed with a screw, they may be fixed through bonding or welding. Or, the diaphragms 30 through 33 and part or entirety of the branch pipe 2 may be integrally formed. The position where the resonator 1 is attached to the intake system 9 is not particularly limited. For example, it may be attached via the air cleaner 91, the cleaner hose 92, the throttle body 93, or the intake manifold 94. A plurality of resonators 1 may be attached to a single intake system 9. In this case, the frequency of the silencing target sound may be changed per resonator 1.

The spring constant, density, thickness, mass or shape of the diaphragms 30 through 33 is not particularly limited. By decreasing the spring constant of the diaphragms 30 through 33, it is possible to decrease the natural frequency of the resonator 1. By increasing the mass, density or thickness of the diaphragms 30 through 33, it is possible to decrease the natural frequency of the resonator 1. The spacing between the diaphragms 30 through 33 is not particularly limited. By arranging the diaphragms 30 through 33 in close proximity to the communication pipe 4 with reduced spacing between them, it is possible to decrease the natural frequency of the resonator 1.

EXAMPLES

Measurement tests such as an acoustic excitation test and a numerical value test (transfer-matrix method) executed on the resonator of the embodiment will be described below.

First Example

The acoustic excitation test executed on the resonator 1 shown in FIG. 7 will be described.

[Test sample]

The specifications of the resonator 1 shown in FIG. 7 will be described. The volume V of the cavity chamber is 0.58 l (liters). The inner diameter D of the cavity chamber is 84 mm. The axial length l of the communication pipe 4 is 17.5 mm. The inner diameter d of the communication pipe 4 is 42 mm. The spring constant k of the diaphragms 30 through 33 is 34.7 N/m. The density p of the diaphragms 30 through 33 is 8.70×102 kg/M$^3$. The thickness t of the diaphragms 30 through 33 is 0.5 mm. The resonator 1 having such specifications is called Example 1.

[Test Method]

Next, the acoustic excitation test will be described. The acoustic excitation test uses a straight tubular pipe having an entire length of 0.6 m whose ends are open, a loudspeaker, and a microphone. To the side wall at the middle section of the straight tubular pipe branches the resonator 1. At one end of the straight tubular pipe is arranged the loudspeaker. At the other end of the straight tubular pipe is arranged the microphone. When while noise is output from the loudspeaker in this state, the white noise is propagated from one end to the other in the straight tubular pipe. The propagated sound is collected by the microphone.

[Test Result]

Figure 8:
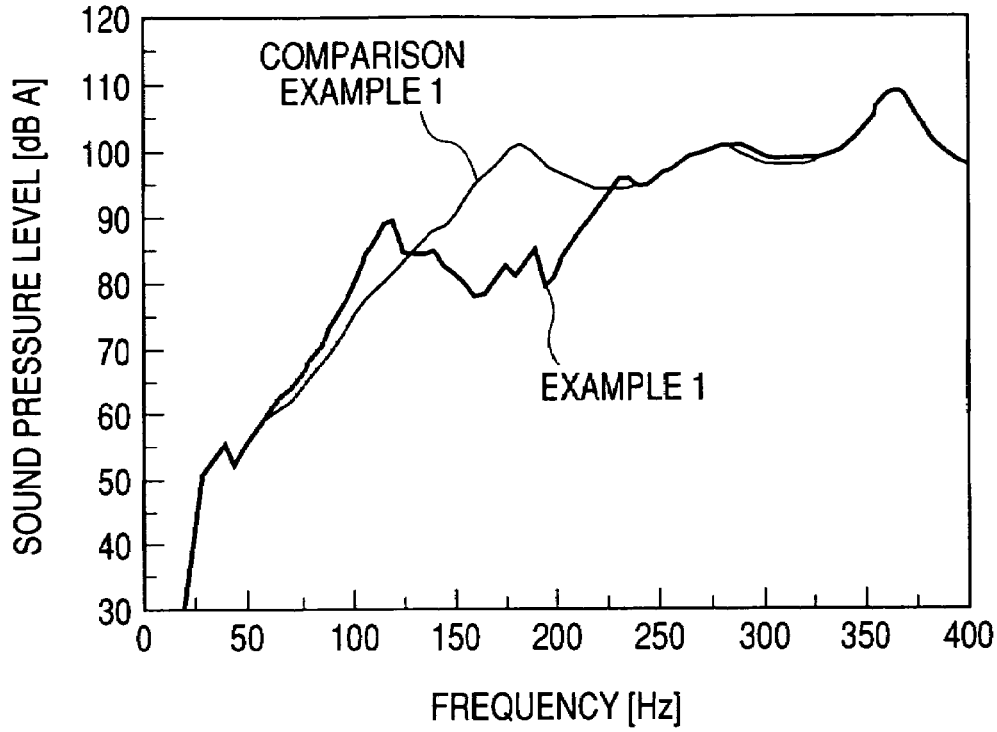
FIG. 8 shows the relationship between the frequency of the sound collected by the microphone and its sound pressure.

Next, the test result will be described. FIG. 8 shows the relationship between the frequency of the sound collected by the microphone and its sound pressure. For comparison, data obtained without a silencer (that is, with the straight tubular pipe alone) is shown as Comparison Example 1. In FIG. 8, bold line data represents Example 1 while fine line data represents Comparison Example 1.

As understood from FIG. 8, Example 1 shows smaller sound pressure than Comparison Example 1 by a maximum of 20 dB in a frequency range of approximately 130 to 225 Hz. In other words, Example 1 has a higher sound pressure suppression effect than Comparison Example 1 in the frequency range of approximately 130 to 225 Hz.

For a Helmholtz resonator having the same volume V of the cavity chamber, inner diameter D of the cavity chamber, axial length l of the communication pipe 4, and inner diameter d of the communication pipe 4 as Example 1, the resonance frequency f may be represented in the following expression, where (8/3p)×0.042 is an opening end correction.

$$f = \frac{340}{2\pi}\sqrt{\frac{\pi \times 0.021^2}{(0.0175 + (8/3\pi) \times 0.042) \times 0.58 \times 10^{-3}}} \quad \text{[Expression 2]}$$

From the above expression, the resonance frequency f is approximately 360 Hz. This calculation result reveals that arrangement of a diaphragm shifts the resonance frequency to lower frequencies.

Example 2

Calculation result of the transfer-matrix method executed on the test samples shown below will be described.

[Test Sample]

Figure 9:
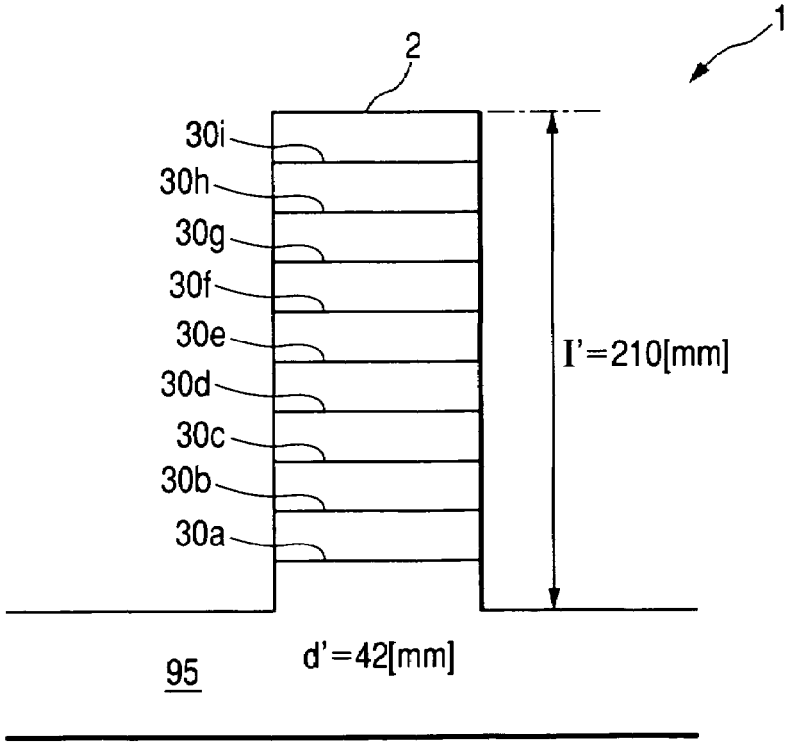
FIG. 9 is a schematic view of the test sample in Example 2-1 of Example 2.
Figure 10:
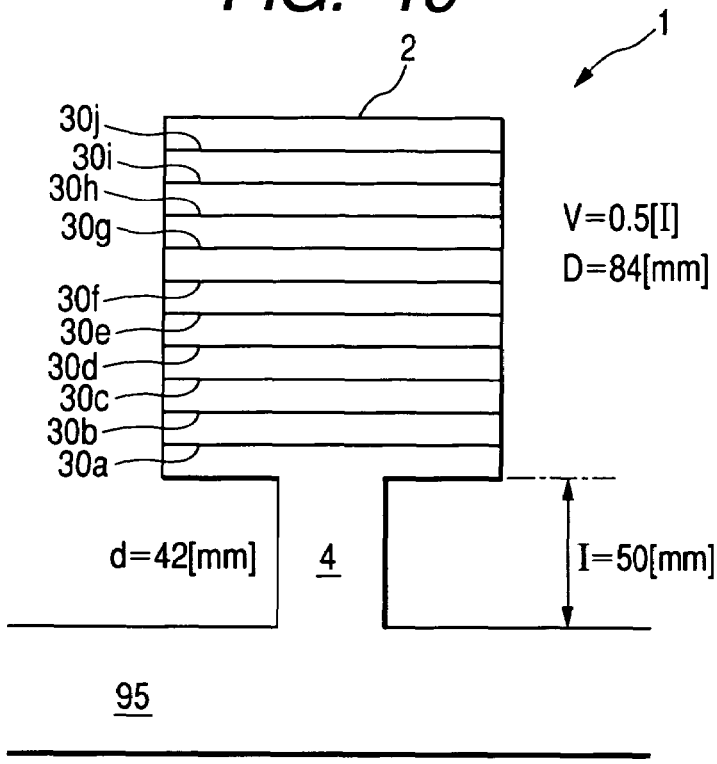
FIG. 10 is a schematic view of the test sample in Example 2-2 of Example 2.
Figure 11:
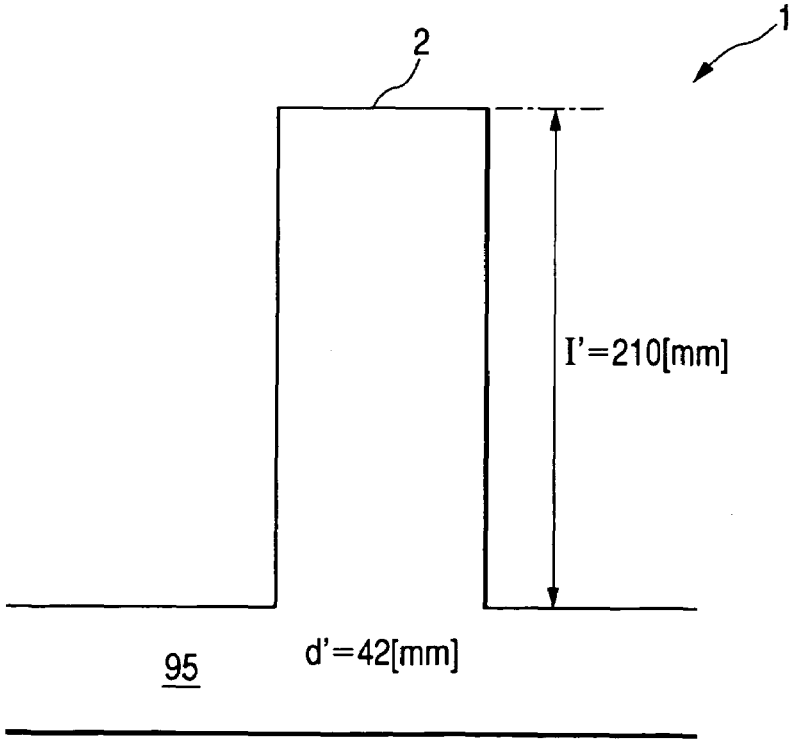
FIG. 11 is a schematic view of the test sample in Comparison Example 2-1 of Example 2.
Figure 12:
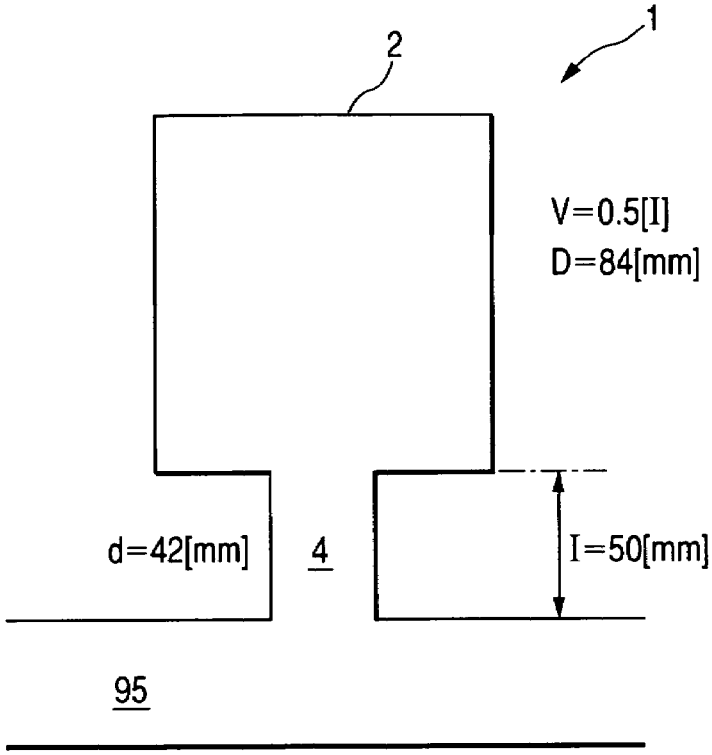
FIG. 12 is a schematic view of the test sample in Comparison Example 2-2 of Example 2.

Specifications of test samples will be described. FIG. 9 is a schematic view of the test sample in Example 2-1. FIG. 10 is a schematic view of the test sample in Example 2-2. FIG. 11 is a schematic view of the test sample in Comparison Example 2-1. FIG. 12 is a schematic view of the test sample in Comparison Example 2-2. In these drawings, sections corresponding to FIG. 7 are given same signs.

Example 2-1 shown in FIG. 9 arranges diaphragms 30*a* through 30*i* in Comparison Example 2-1 shown in FIG. 11 (side branch resonator). A branch pipe 2 shows a shape of a cylinder with a bottom. The spring constant k of the diaphragms 30*a* through 30*i* is 139 N/m. The density p of the diaphragms 30*a* through 30*i* is 8.70×102 kg/M$^3$. The thickness t of the diaphragms 30*a* through 30*i* is 0.5 mm. The inner diameter d' of the branch pipe 2 in Example 2-1 (FIG. 9) and Comparison Example 2-1 (FIG. 11) is 42 mm. The axial length l' of the branch pipe 2 is 210 mm.

Example 2-2 shown in FIG. 10 arranges diaphragms 30*a* through 30*i* in Comparison Example 2-2 shown in FIG. 12 (Helmholtz resonator). The spring constant k of the diaphragms 30*a* through 30*j* is 34.7 N/m. The density p of the diaphragms 30*a* through 30*j* is 8.70×102 kg/M$^3$. The thickness t of the diaphragms 30*a* through 30*j* is 0.5 mm. The volume V of the cavity chamber shown in Example 2-2 (FIG. 10) and Comparison Example 2-2 (FIG. 12) is 0.5 1 (liters). The inner diameter D of the cavity chamber is 84 mm. The axial length 1 of the communication pipe 4 is 50 mm. The inner diameter d of the communication pipe 4 is 42 mm.

[Calculation Method]

Next, the calculation method will be described. Calculation is performed using the transfer-matrix method. That is, the intake system 9 is schematically represented as a series of conduit elements and the intake noise is treated as a one-dimensional factor. The transfer-matrix method is well known so that details of the method are omitted.

[Calculation Result]

Calculation result of the primary resonance frequency by the transfer-matrix method is shown in Table 1.

TABLE 1

| EXAMPLE | Primary resonance frequency (Hz) |
|---|---|
| Example 2-1 | 128 |
| Comparison Example 2-1 | 406 |
| Example 2-2 | 140 |
| Comparison Example 2-2 | 370 |

From the calculation result, it is understood that Example 2-1 shows a lower primary resonance frequency than Comparison Example 2-1 and Example 2-2 shows a lower primary resonance frequency than Comparison Example 2-2. This calculation result reveals that arrangement of a diaphragm shifts the resonance frequency to lower frequencies.

Example 3

The acoustic excitation test executed on the following test samples will be described. The text method is as mentioned earlier so that its details are omitted.

[Test Sample]

Figure 13:
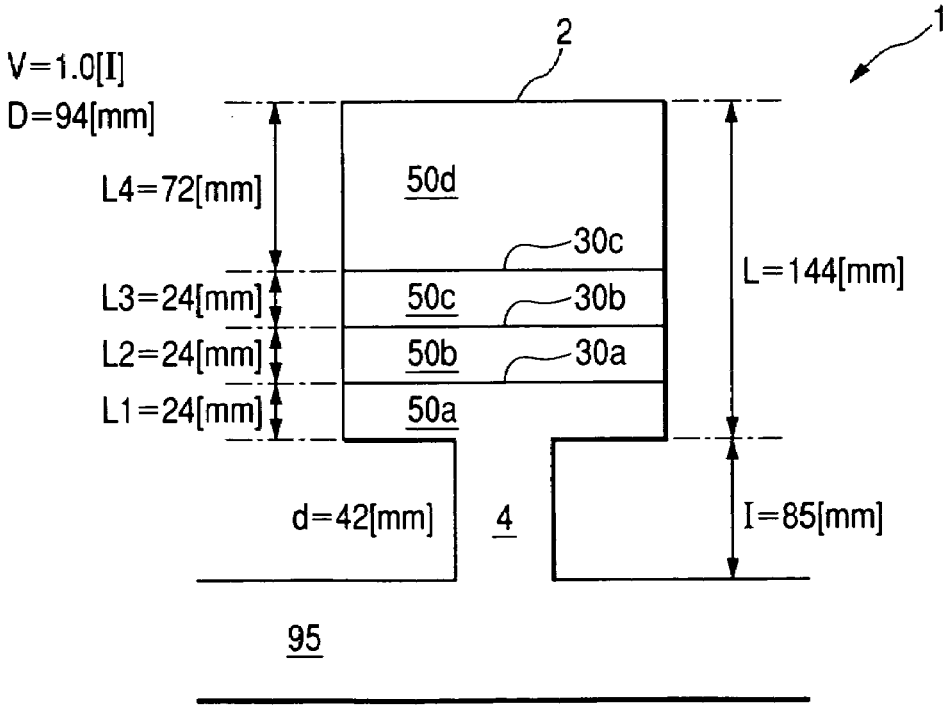
FIG. 13 is a schematic view of the test sample in Example 3-1 of Example 3.
Figure 14:
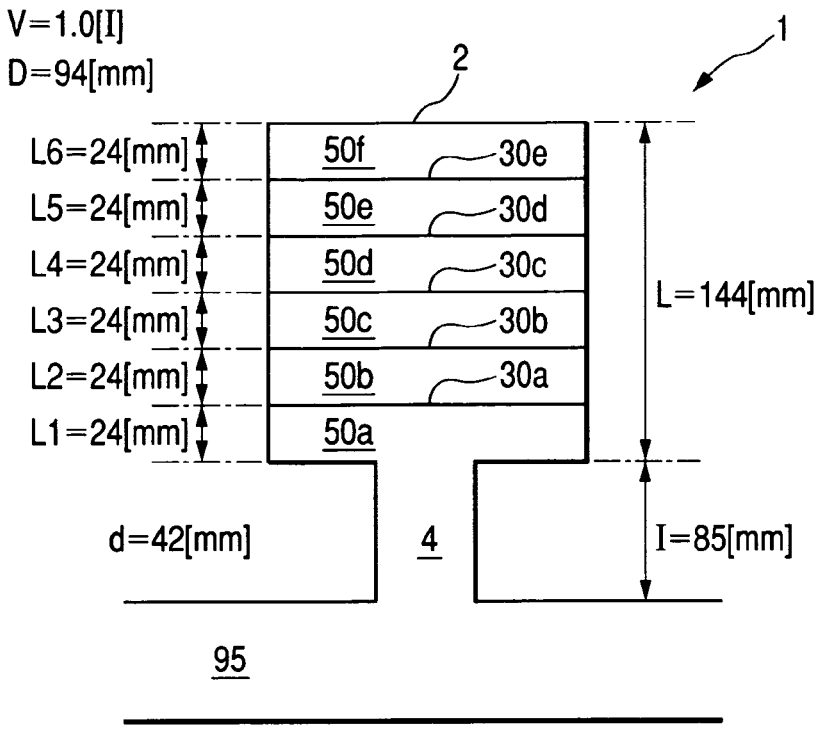
FIG. 14 is a schematic view of the test sample in Example 3-2 of Example 3.
Figure 15:
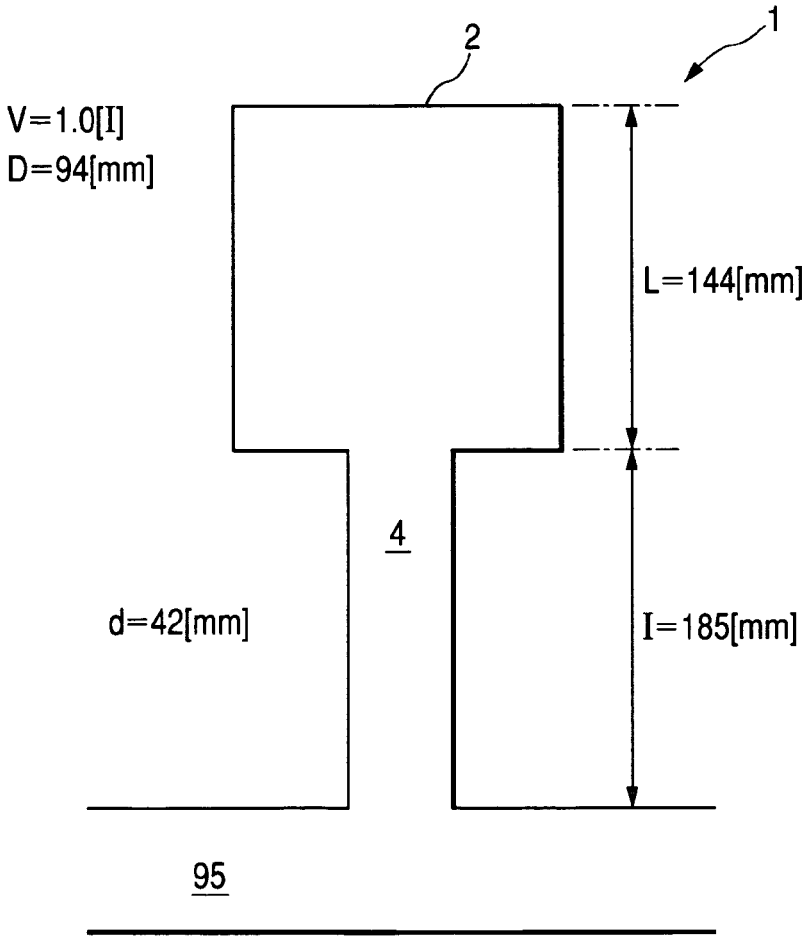
FIG. 15 is a schematic view of the test sample in Comparison Example 3-2 of Example 3.

Specifications of test samples will be described. FIG. 13 is a schematic view of the test sample in Example 3-1. FIG. 14 is a schematic view of the test sample in Example 3-2. FIG. 15 is a schematic view of the test sample in Comparison Example 3-2. In these drawings, sections corresponding to FIG. 7 are given same signs.

The volume V of the cavity chamber shown in Example 3-1 is 1.0 1 (liter). The inner diameter D of the cavity chamber is 94 mm. The axial length L of the cavity chamber is 144 mm. The axial lengths L1 through L3 of the pneumatic spring chambers 50*a* through 50*c* each is 24 mm. The axial length L4 of the pneumatic spring chamber 50*d* is 72 mm. The axial length l of the communication pipe 4 is 85 mm. The inner diameter d of the communication pipe 4 is 42 mm. The spring constant k of the diaphragms 30*a* through 30*c* is 13.8 N/m. The mass m of the diaphragms 30*a* through 30*c* is 3.26 g. The thickness t of the diaphragms 30*a* through 30*c* is 0.5 mm.

The volume V of the cavity chamber shown in Example 3-2 is 1.0 1 (liter). The inner diameter D of the cavity chamber is 94 mm. The axial length L of the cavity chamber is 144 mm. The axial lengths L1 through L6 of the pneumatic spring chambers 50*a* through 50*f* are respectively 24 mm. The axial length l of the communication pipe 4 is 85 mm. The inner diameter d of the communication pipe 4 is 42 mm. The spring constant k of the diaphragms 30*a* through 30*e* is 13.8 N/m. The mass m of the diaphragms 30*a* through 30*e* is 3.26 g. The thickness t of the diaphragms 30*a* through 30*e* is 0.5 mm.

Comparison Example 3-1 shows a case where a resonator is not arranged in the straight tubular pipe used for the acoustic excitation test. The volume V of the cavity chamber shown in Comparison Example 3-2 is 1.0 1 (liter). The inner diameter D of the cavity chamber is 94 mm. The axial length L of the cavity chamber is 144 mm. The axial length l of the communication pipe 4 is 185 mm. The inner diameter d of the communication pipe 4 is 42 mm.

[Test Result]

Figure 16:
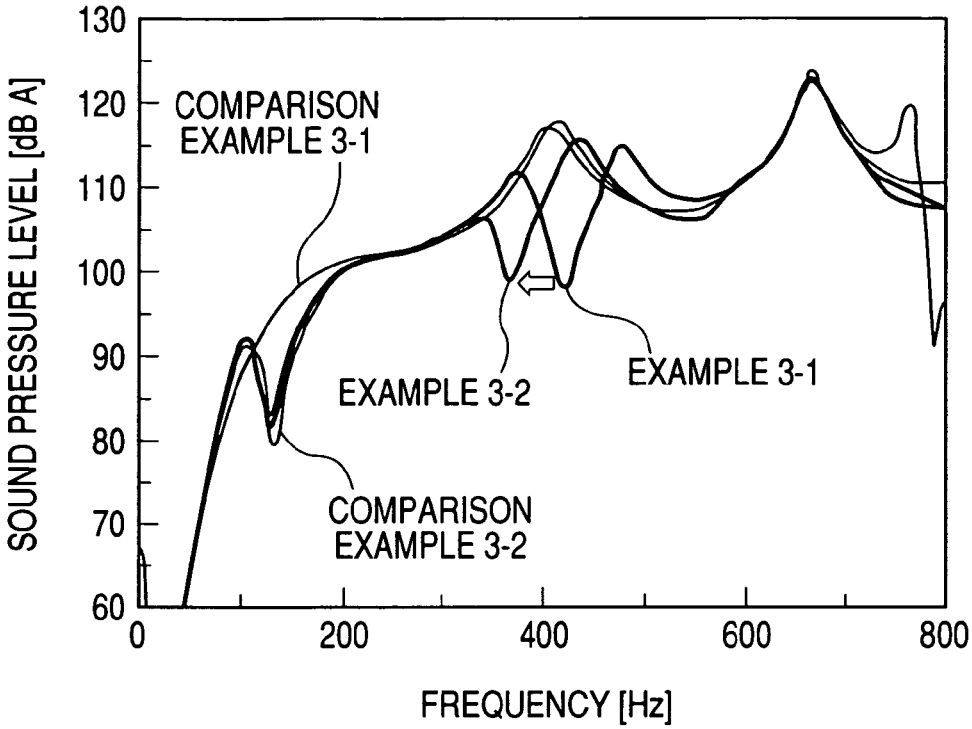
FIG. 16 shows the relationship between the frequency of the sound collected by the microphone and its sound pressure in Example 3.

Next, the test result will be described. FIG. 16 shows the relationship between the frequency of the sound collected by the microphone and its sound pressure. In FIG. 16, bold line data represents examples while fine line data represents comparison examples.

From FIG. 16, it is understood that the primary resonance frequency shown in Example 3-1 is 130 Hz. It is understood that the primary resonance frequency shown in Example 3-2 is 128 Hz. It is understood that the primary resonance frequency shown in Comparison Example 3-2 is 132 Hz. In other words, it is understood that Examples 3-1, 3-2 have approximately the same frequency as Comparison Example 3-2. Although the axial length l of the communication pipe 4 is as small as 100 mm (185-85), Examples 3-1, 3-2 have the almost equivalent sound pressure suppression effect as Comparison Example 3-2.

It is understood that secondary resonance occurs near 440 Hz in Example 3-1. Similarly, it is understood that secondary resonance occurs near 380 Hz in Example 3-2. Such secondary resonance occurs because a diaphragm has been arranged, or in other words, the freedom of the resonator has increased. For the secondary resonance also, it is possible to suppress the sound pressure of the intake noise. As understood from the comparison between Example 3-1 and Example 3-2, increasing the number of diaphragms shifts the secondary resonance frequency toward lower frequencies (indicated by an arrow in the drawing).

Example 4

Text result of the transfer-matrix method executed on the following test samples will be described. The calculation method is as mentioned earlier so that its details are omitted.

[Test Sample]

Specifications of test samples will be described. The test samples used in Example 4 are same as those used in Example 3. The specifications of Example 4-1 is the same as Example 3-1, the specifications of Example 4-2 is the same as Example 3-2, the specifications of Comparison Example 4-1 is the same as Comparison Example 3-1, and the specifications of Comparison Example 4-2 is the same as Comparison Example 3-2.

[Calculation Result]

Figure 17:
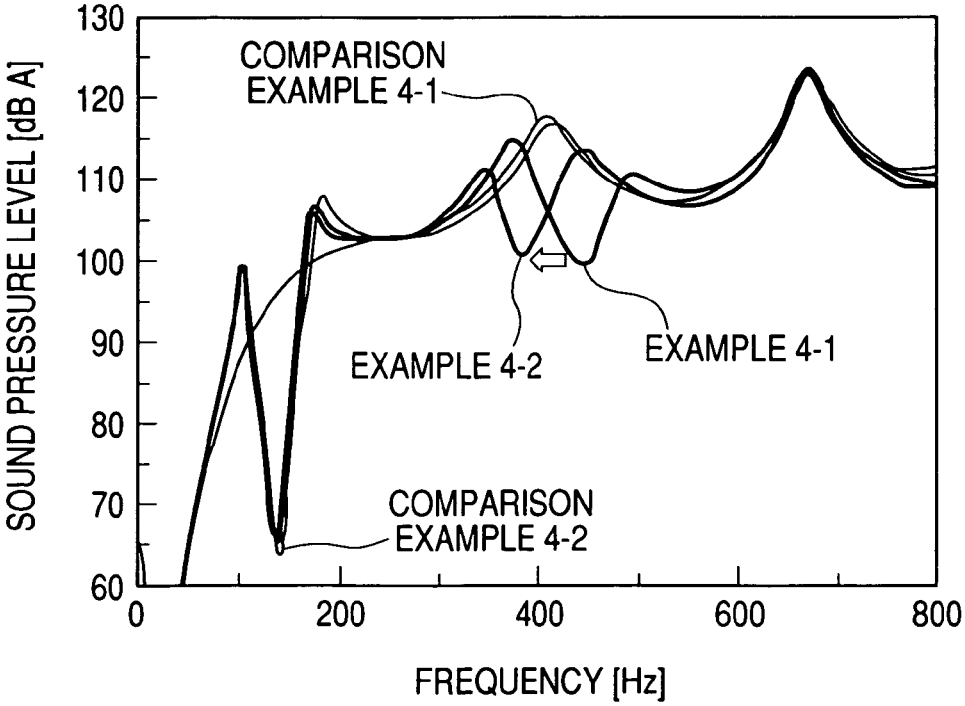
FIG. 17 shows the relationship between the frequency of the sound calculated by the transfer-matrix method and its sound pressure in Example 4.

Next, the calculation result will be described. FIG. 17 shows the relationship between the frequency of the sound calculated by the transfer-matrix method and its sound pressure. In FIG. 17, bold line data represents examples while fine line data represents comparison examples.

From FIG. 17, it is understood that Examples 4-1, 4-2 has an approximately same primary resonance frequency (approximately 130 Hz) as Comparison Example 4-2. It is understood that Examples 4-1, 4-2 have the almost equivalent sound pressure suppression effect as Comparison Example 4-2.

It is understood that secondary resonance occurs near 440 Hz in Example 4-1. Similarly, it is understood that secondary resonance occurs near 380 Hz in Example 4-2. Such secondary resonance occurs because a diaphragm has been arranged, or in other words, the freedom of the resonator has increased. For the secondary resonance also, it is possible to suppress the sound pressure of the intake noise. As understood from the comparison between Example 4-1 and Example 4-2, increasing the number of diaphragms shifts the secondary resonance frequency toward lower frequencies (indicated by an arrow in the drawing).

Example 5

Text result of the transfer-matrix method executed on the following test samples will be described. The calculation method is as mentioned earlier so that its details are omitted.

[Test Sample]

Specifications of test samples will be described. In Example 5, the spacing between the diaphragms 30*a* through 30*e* shown in Example 3-2 (refer to FIG. 14) has been changed. The volume V of the cavity chamber is 1.0 1 (liter). The inner diameter D of the cavity chamber is 94 mm. The axial length L of the cavity chamber is 144 mm. The axial lengths L1 through L5 of the pneumatic spring chambers 50*a* through 50*e* each is 5 mm. The axial length L4 of the pneumatic spring chamber 50*f* is 119 mm. The axial length l of the communication pipe 4 is 85 mm. The inner diameter d of the communication pipe 4 is 42 mm. The spring constant k of the diaphragms 30*a* through 30*e* is 13.8 N/m. The mass m of the diaphragms 30*a* through 30*e* is 3.26 g. The thickness t of the diaphragms 30*a* through 30*e* is 0.5 mm. The test samples having the above specifications are called Example 5-1. That is, the diaphragms 30*a* through 30*e* of Example 5-1 are arranged toward the communication pipe 4 when compared with the diaphragms 30*a* through 30*e* shown in Example 3-2. A test sample having a thickness t of the diaphragms 30*a* through 30*e* in Example 5-1 equal to 1 mm is defined as Example 5-2.

[Calculation result]

Figure 18:
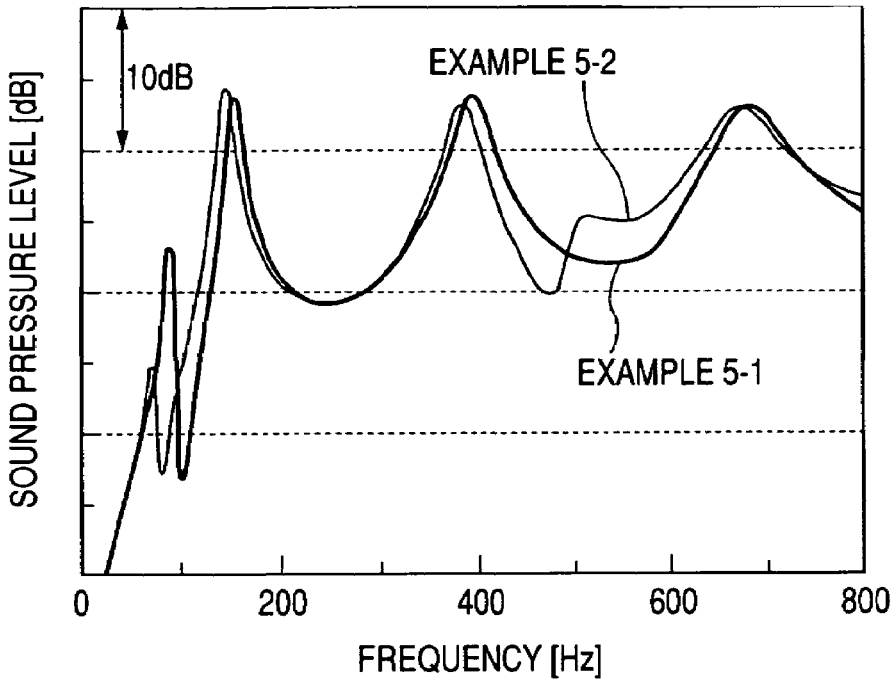
FIG. 18 shows the relationship between the frequency of the sound calculated by the transfer-matrix method and its sound pressure in Example 5.

Next, the calculation result will be described. FIG. 18 shows the relationship between the frequency of the sound calculated by the transfer-matrix method and its sound pressure. In FIG. 18, bold line data represents Example 5-1 while fine line data represents Example 5-2.

From the calculation result, it is understood that the primary resonance frequency shown in Example 5-1 is 100 Hz. As mentioned earlier, the primary resonance frequency shown in Example 4-2 (calculation result of Example 3-2) is approximately 130 Hz (refer to FIG. 17). It is understood that arranging the diaphragms 30*a* through 30*e* in close proximity to the communication pipe 4 with reduced spacing between them shifts the natural frequency of the resonator 1 toward lower frequencies.

From the calculation result, it is understood that the primary resonance frequency shown in Example 5-2 is 80 Hz. That is, it is understood that increasing the thickness of the diaphragms 30*a* through 30*e* shifts the natural frequency of the resonator 1 toward lower frequencies.

Example 6

Result of the test executed on the test samples shown below will be described.

[Test Sample]

Figure 19:
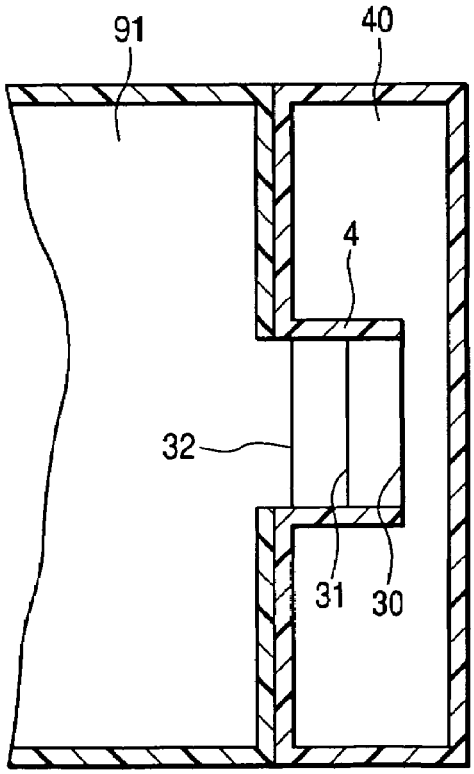
FIG. 19 is a schematic view of the test sample in Example 6.

Specifications of test samples will be described. FIG. 19 is a schematic view of the test sample in Example 6. The resonator is provided along the side of the air cleaner 91. The resonator comprises a communication pipe 4 in communication with the air cleaner 91 and a cavity chamber 40. The communication pipe 4 is positioned in the cavity chamber 40. Three rubber diaphragms 30 through 32 are arranged in the communication pipe 4.

The communication pipe 4 has a shape of a cylinder 80 mm in inner diameter and 20 mm in length. One end of the communication pipe 4 is in communication with the air cleaner 91 and extends inside the cavity chamber 40. The other end of the communication pipe 4 is open in the cavity chamber 40. The cavity chamber 40 is formed in a box whose inner dimensions are 260 mm by 120 mm by 32 mm. The volume V of the cavity chamber excluding the volume of the communication pipe 4 (0.1 liters) is 0.88 liters.

The diaphragms 30 through 32 each is made of a rubber film 0.5 mm in thickness, that constitutes a partitioning member of the invention, and held in the communication pipe 4 with spacing of 10 mm. The diaphragms 30 through 32 each has a mass of 2.36 g, Young's modulus of 1.64 MPa (300 Hz), and Poisson'S ratio of 0.5.

[Test Method]

The resonator 4 is attached to the air cleaner 91 of a 4-cylinder engine. A microphone is arranged at the intake port. The sound pressure of the secondary rotation component obtained at each engine revolutions is measured.

Figure 20:
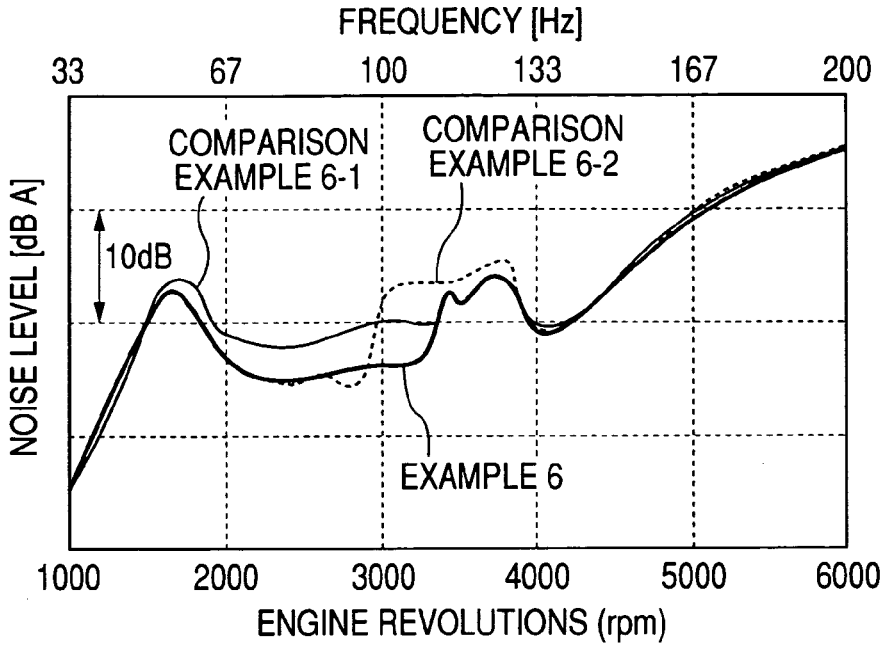
FIG. 20 shows the relationship between the frequency of the sound collected by the microphone and its sound pressure in Example 6.

Next, the test result will be described below. FIG. 20 shows the relationship between the frequency of the sound collected by the microphone and its sound pressure. For comparison, data obtained without using a silencer is shown as Comparison Example 6-1. Data obtained using, as an intake pipe, a general resonator whose cavity chamber volume V is 0.88 liters and comprising a communication pipe 26 mm in diameter and 200 mm in length is shown as Comparison Example 6-2. In FIG. 20, bold line data represents Example 6 while fine line data represents Comparison Example 6-1 and broken line data represents Comparison Example 6-2, respectively.

As shown in FIG. 20, Example 6 shows that sound pressure is smaller, by 4.6 dB at maximum, than that in Comparison Example 6 at engine revolutions of 1490 through 3670 rpm (frequency range of approximately 50 to 112 Hz). In other words, Example 6 has a higher sound pressure suppression effect than Comparison Example 6 in the frequency range of approximately 50 to 112 Hz.

Figure 21:
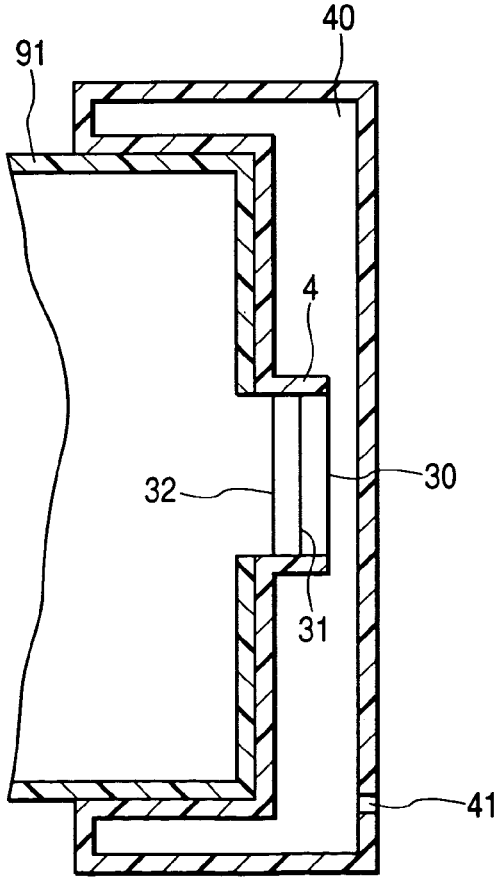
FIG. 21 is a cross sectional view of another aspect of the resonator of Example 6 attached to an air cleaner.

The resonator according to this embodiment has a cavity chamber whose thickness as thin as approximately 30 mm. Mounting the resonator on an air cleaner does not provide a bulky configuration, which is advantageous in terms of space saving. As shown in FIG. 21, it is possible to bend the cavity chamber 40 so that it will lie along the three faces of the air cleaner 91. This approach will provide a lower-profile design of the cavity chamber 40. For example, a configuration including the cavity chamber 40 as thick as 10 mm and the communication pipe 4 as long as 5 mm may provide the same effect.

For the resonator according to Embodiment 6, the air inside the cavity chamber 40 is inflated/contracted due to a change in the temperature of outside air, which exerts an excessive pressure on the diaphragms 30 through 32. In this case, as shown in FIG. 21, a small hole 41 (1 to 3 mm in diameter) may be formed in the cavity chamber 40 that communicates the inside and outside of the cavity chamber 40.

Example 7

An intake system to an engine is shown in Example 7, in which a resonator 71 according to one embodiment of the invention is disposed.

Basic structure of this intake system will be described with FIGS. 22 through 24.

Figure 22:
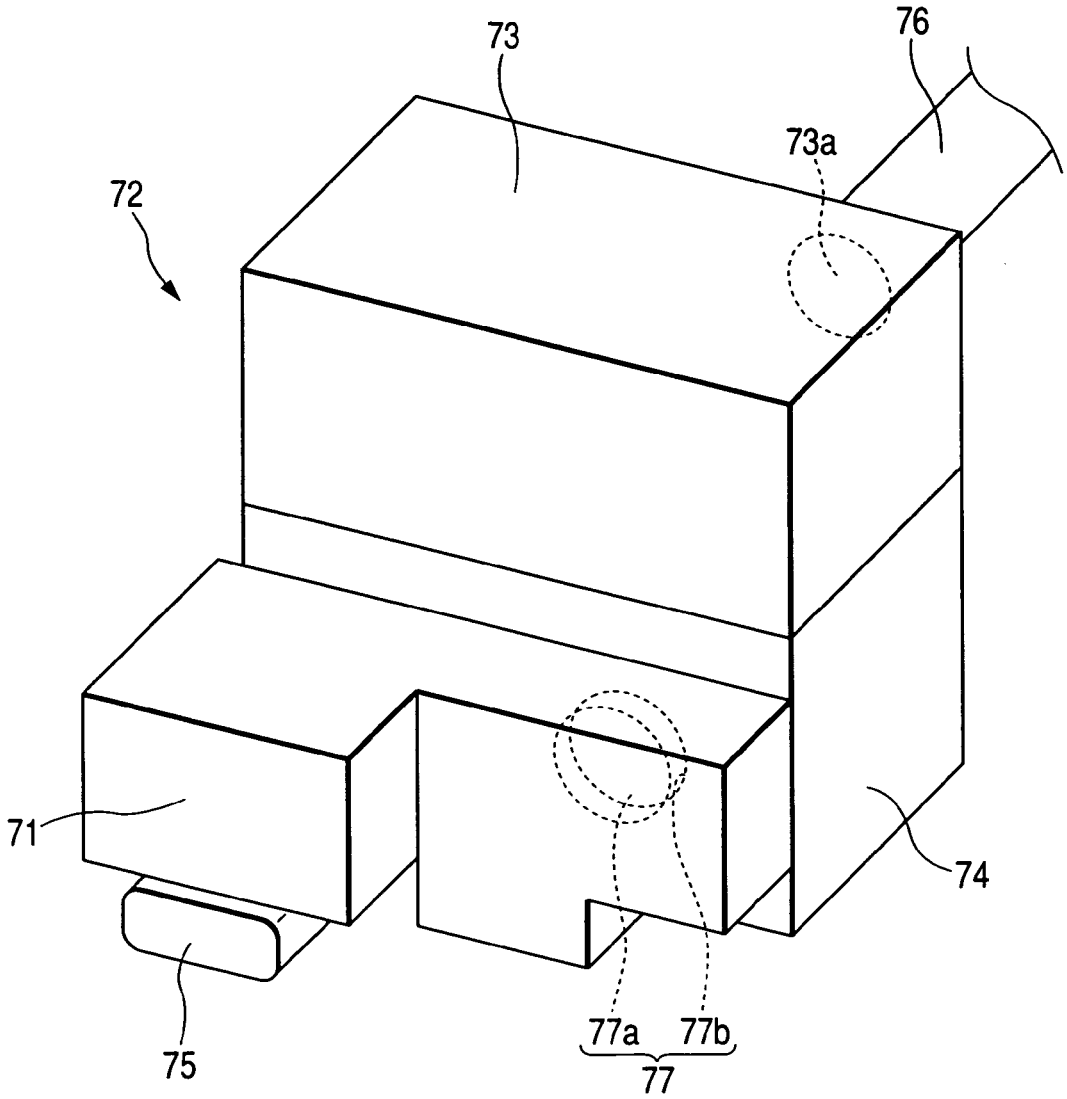
FIG. 22 is a schematic perspective view of the test sample in Example 7-1 of Example 7.

As shown in FIG. 22, the resonator 71 is disposed adjacent to an air clear 72 of the intake system. The air clear 72 is provided with an upper case 73 and a lower case 74 that are stacked in vertical direction. As shown in FIG. 23, an intake duct 75 is connected to the lower case 74 on one side wall in a vicinity of the bottom of the lower case 74. An air cleaner hose 76 is connected to the upper case 73 at an air hose attachment position 73*a* on one side wall of the upper case which is opposite to the side wall of the lower case 74 to which the intake duct 75 is connected. In the above structure, the air sucked in the intake duct 75 is sent to a combustion chamber (not-shown) in the engine, purified by passing through the air clear 72.

Figure 24:
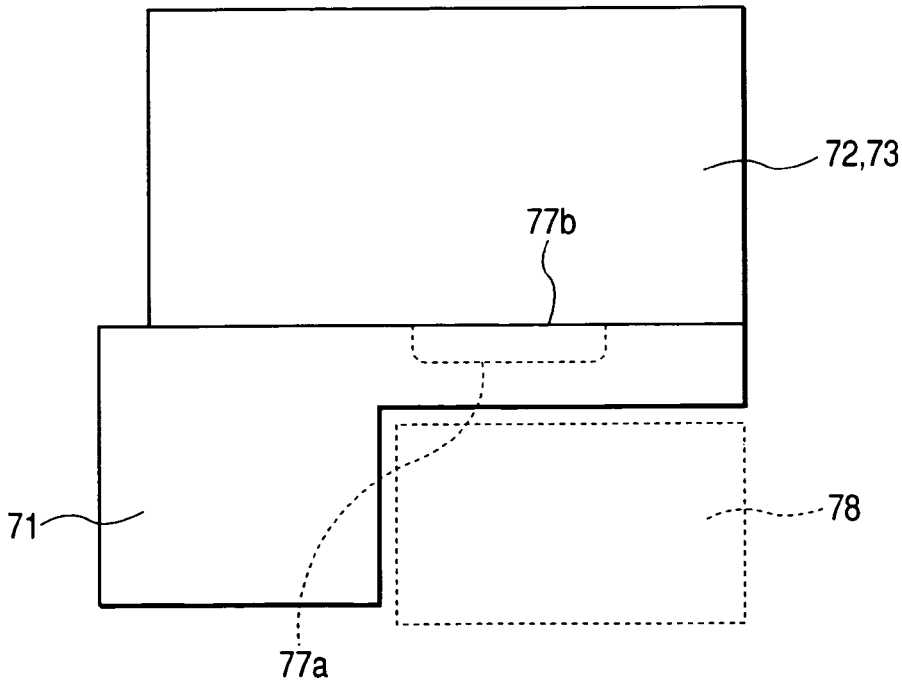
FIG. 24 is a schematic plan view of the test sample in Example 7-1 of Example 7.

In the resonator 71, as shown in FIG. 24, an opening is formed on an attachment surface to the air cleaner 72, communicating with an opening formed on a side face of the air cleaner 72, so that a communication portion 77 is formed. A plurality of films (two in this embodiment) 77*a*, 77*b* are disposed in the communication portion 77 so as to shield the communication between the resonator 71 and the air cleaner 72.

Incidentally, as shown in FIG. 24, a battery mount position 78 on which a battery (not-shown) is to be mounted is located on a side of the resonator 71 opposite to the air clear 72. The resonator 71 has to be provided so as not to interfere with the battery. The volume of the resonator 71 is therefore limited.

[Test Sample]

Figure 23:
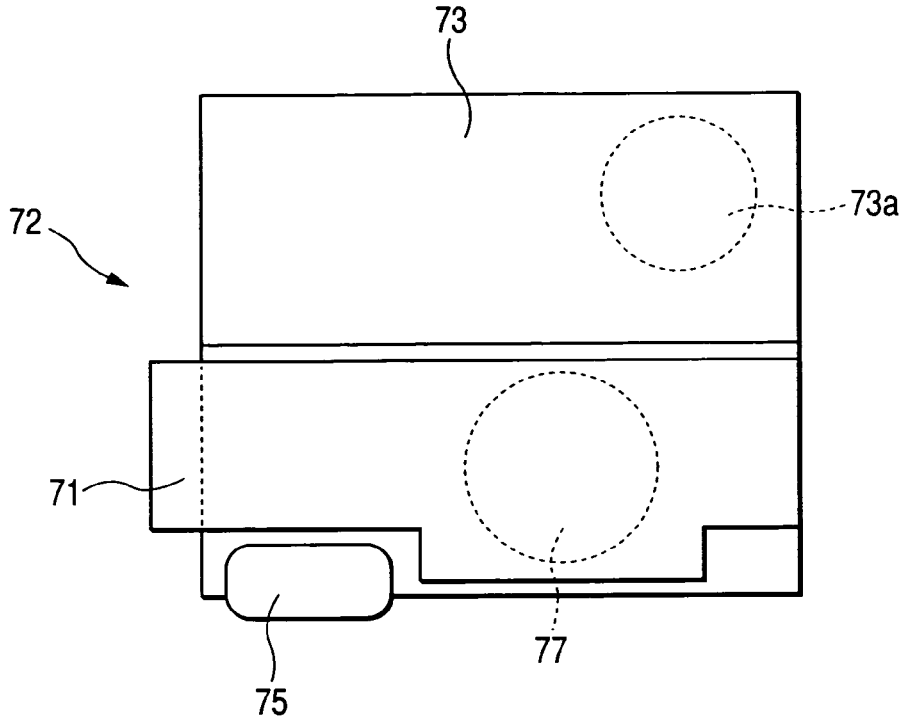
FIG. 23 is a schematic front view of the test sample in Example 7-1 of Example 7.

The intake system in which the resonator 71 is mounted as shown in FIGS. 22 through 24 is served as Example 7-1.

Specifications of the resonator 71 will be described. The volume of the resonator 71 is 2.2 l(liters). The inner diameter D of the communication portion 77 is 80 mm. Each of the films 77*a*, 77*b* has a thickness of 0.5 mm and disposed at a distance of 20 mm to each other. The films 77*a*, 77*b* each has a mass of 2.36 g, Young's modulus of 1.64 MPa (300 Hz), and Poisson'S ratio of 0.5. The resonance frequency of the resonator 71 is 85 Hz.

For comparison, data obtained without using a silencer is served as Comparison Example 7-1. Data obtained using, as an intake pipe, a Helmholtz resonator comprising a communication pipe 27 mm in diameter and 76 mm in length is shown as Comparison Example 7-2. In Comparison Example 7-2, the communication pipe is provided for communication between the resonator 71 and the air cleaner 72 in place of the communication portion 77 such that both ends of the communication pipe project into the air cleaner case and the resonator, respectively.

[Test Method]

Actual measurement tests similar to Example 6 are conducted to Example 7-1, Comparative Examples 7-1 and 7-2. The sound pressure of the primary explosion component obtained at each engine revolutions is measured.

[Test Result]

Figure 25:
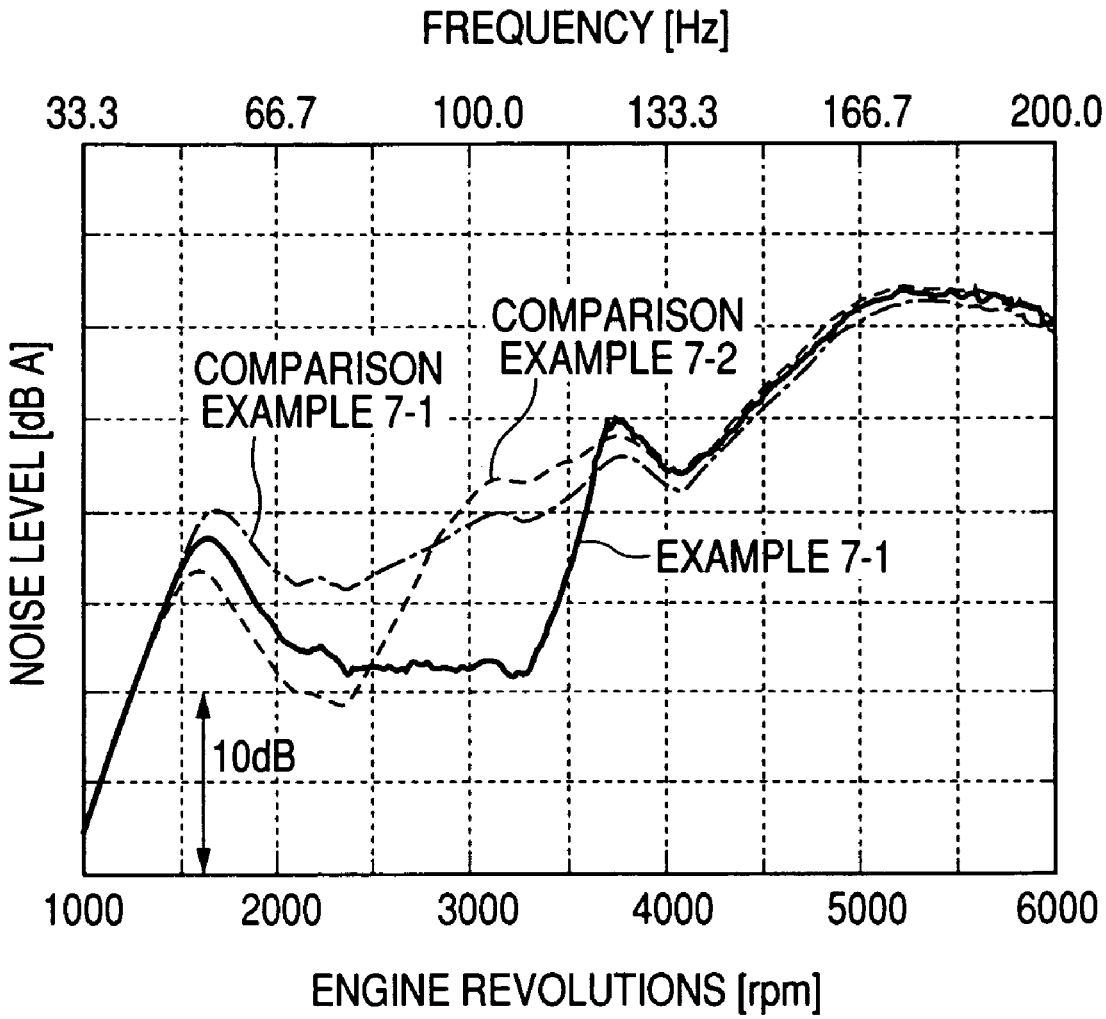
FIG. 25 shows the relationship between the frequency of the sound collected by the microphone and its sound pressure in Example 7.

Next, the test result will be described below. FIG. 25 shows the relationship between the frequency of the sound collected by the microphone and its sound pressure. In FIG. 25, bold line data represents Example 7-1 while broken line data represents Comparison Example 7-1 and chain line data represents Comparison Example 7-2, respectively.

As shown in FIG. 25, Example 7-1 shows that sound pressure is smaller, by 9.0 dB at maximum, than that in Comparison Example 7-1, at engine revolutions of 1500 through 3600 rpm (frequency range of approximately 50 to 120 Hz). In other words, Example 7-1 has a higher sound pressure suppression effect than Comparison Example 7-1 in a wide frequency range of approximately 50 to 120 Hz.

What is claimed is:

1. A resonator arranged in an intake system having a pipe section for partitioning an intake port from an intake passage that communicates the intake port with a combustion chamber of an engine, said resonator comprising:

a branch pipe having one end branching from said pipe section and another end closed so that a silencing chamber is defined therein; and a partitioning member provided only in the branch pipe to shield a cavity chamber, which is formed behind the partitioning member, wherein the partitioning member has a natural frequency lower than a frequency of silencing target sound propagated from the intake passage such that the partitioning member does not vibrate at the frequency of the silencing target sound, a cross sectional area of the branch pipe is smaller than that of the cavity chamber, and the partitioning member is not located in the cavity chamber.

2. The resonator according to claim 1, wherein said natural frequency of said partitioning member is less than 10 percent of the resonance frequency of the resonance sound calculated from the mass of said partitioning member and the spring constant of said cavity chamber with the latter being assumed as 100 percent.

3. The resonator according to claim 1, wherein said spring constant of said partitioning member is less than 1 percent assuming the spring constant of the cavity chamber adjacent to the rear of the partitioning member as 100 percent.

4. The resonator according to claim 1, wherein said branch pipe is arranged at a site where the antinode of a standing wave of a frequency of the silencing target sound is positioned in said pipe section.

5. The resonator according to claim 1, wherein the branch pipe includes a mounting base part, at least one intermediate coupling part, and an end part.

6. An intake system to a combustion chamber in an engine, comprising:

an intake passage through which air flows;

an intake port connected to the intake passage to provide the air;

a resonator communicated with the intake passage through a communication portion;

a partitioning member provided only in the communication portion to shield a chamber, which is formed behind the partitioning member, wherein the partitioning member has a natural frequency lower than a frequency of silencing target sound propagated from the intake passage such that the partitioning member does not vibrate at the frequency of the silencing target sound, a cross sectional area of the communication portion is smaller than that of the cavity chamber, and the partitioning member is not located in the cavity chamber.

7. The intake system according to claim 6, wherein the resonator is attached to communicate with the intake passage through a communication pipe.

8. The intake system according to claim 6, wherein the intake passage includes an air cleaner, and the resonator attached to the air cleaner so as to communicate therebetween.

9. The intake system according to claim 6, wherein the partitioning member is provided with a partition wall.

10. The intake system according to claim 8, wherein the air cleaner includes an upper case to which an outlet of the air is connected, and a lower case on which the upper case is stacked and which is communicated with the intake port, and the resonator is attached to the lower case of the air cleaner.

11. The resonator of claim 1, wherein the cavity chamber is downstream of the branch pipe and the partitioning member in a sound propagating direction.

12. The resonator of claim 6, wherein the cavity chamber is downstream of the branch pipe and the partitioning member in a sound propagating direction.

* * * * *